US010036344B2

(12) United States Patent
Mc Clearen et al.

(10) Patent No.: US 10,036,344 B2
(45) **Date of Patent: *Jul. 31, 2018**

(54) OPPOSED PISTON TWO STROKE ENGINE LINER CONSTRUCTION

(71) Applicant: AVL Powertrain Engineering, Inc., Plymouth, MI (US)

(72) Inventors: James Mc Clearen, Brighton, MI (US); Jeffrey Wayne Klaver, Ypsilanti, MI (US); Gary L. Hunter, Brighton, MI (US)

(73) Assignee: AVL POWERTRAIN ENGINEERING, INC., Plymouth, MI (US)

( * ) Notice: Subject to any disclaimer, the term of this patent is extended or adjusted under 35 U.S.C. 154(b) by 260 days.

This patent is subject to a terminal disclaimer.

(21) Appl. No.: 15/050,707

(22) Filed: Feb. 23, 2016

(65) Prior Publication Data

US 2016/0252043 A1 Sep. 1, 2016

Related U.S. Application Data

(60) Provisional application No. 62/126,088, filed on Feb. 27, 2015, provisional application No. 62/121,777, filed on Feb. 27, 2015.

(51) Int. Cl.
*F02F 5/00* (2006.01)
*F02F 1/00* (2006.01)
(Continued)

(52) U.S. Cl.
CPC ..... *F02F 1/004* (2013.01); *F02F 1/02* (2013.01); *F02F 1/186* (2013.01); *F02F 3/00* (2013.01)

(58) Field of Classification Search
CPC .... F02F 1/004; F02F 1/02; F02F 1/186; F02F 3/00
(Continued)

(56) References Cited

U.S. PATENT DOCUMENTS 2,068,038 A 1/1937 Prothero et al.
2,421,868 A 6/1947 Bovee
(Continued)

FOREIGN PATENT DOCUMENTS

CN 204164363 U 2/2015
DE 19646930 A1 5/1997
(Continued)

OTHER PUBLICATIONS

Pirault, Jean-Pierre et al. Opposed-Piston Engine Renaissance. 2010 Archates Power, Inc. pp. 1-17.
(Continued)

*Primary Examiner* — Marguerite McMahon
(74) *Attorney, Agent, or Firm* — Harness, Dickey & Pierce, P.L.C.

(57) ABSTRACT

An example of a cylinder liner according to the present disclosure includes a first portion having a first end and a second end and a second portion having a first end and a second end. The second portion is separate from the first portion and the second end of the first portion overlays the first end of the second portion. The first portion and the second portion are configured to receive a piston slideably disposed within the first portion and the second portion.

36 Claims, 7 Drawing Sheets

(51) Int. Cl.
*F02F 1/18* (2006.01)
*F02F 1/02* (2006.01)
*F02F 3/00* (2006.01)

(58) Field of Classification Search
USPC ..... 123/193.2, 193.3, 51 R–51 BD
See application file for complete search history.

(56) References Cited

U.S. PATENT DOCUMENTS

| | | | | | |
|---|---|---|---|---|---|
| 2,423,395 | A | † | 7/1947 | Lieberherr | |
| 2,446,841 | A | | 8/1948 | Lieberherr | |
| 2,703,077 | A | † | 3/1955 | Antonsen | |
| 2,853,983 | A | | 9/1958 | Sawle | |
| 2,996,050 | A | | 8/1961 | Caris | |
| 2,998,808 | A | † | 9/1961 | Jackson | |
| 3,023,743 | A | | 3/1962 | Schauer | |
| 3,084,678 | A | | 4/1963 | Lindsay | |
| 3,320,940 | A | | 5/1967 | Mitchell et al. | |
| 4,013,058 | A | | 3/1977 | Hafner et al. | |
| 4,216,747 | A | | 8/1980 | Noguchi et al. | |
| 4,527,516 | A | | 7/1985 | Foster | |
| 4,638,769 | A | | 1/1987 | Ballheimer | |
| 4,706,616 | A | * | 11/1987 | Yoshimitsu | F02B 77/02 123/193.2 |
| 4,953,528 | A | * | 9/1990 | Oikawa | F02B 19/165 123/271 |
| 5,188,066 | A | | 2/1993 | Gustavsson | |
| D370,712 | S | | 6/1996 | Clark et al. | |
| 5,727,512 | A | | 3/1998 | Hutchins | |
| 7,360,511 | B2 | † | 4/2008 | Lemke | |
| 7,591,235 | B2 | | 9/2009 | Lemke et al. | |
| 8,413,619 | B2 | | 4/2013 | Cleeves | |
| 8,539,918 | B2 | † | 9/2013 | Lemke | |
| 8,549,854 | B2 | | 10/2013 | Dion et al. | |
| 8,789,499 | B2 | | 7/2014 | Alonso | |
| 9,121,365 | B1 | † | 9/2015 | Wagner | |
| 9,328,692 | B2 | | 5/2016 | Rado et al. | |
| 9,435,290 | B2 | | 9/2016 | Fuqua | |
| 9,771,861 | B2 | * | 9/2017 | McClearen | F02B 75/02 |
| 2007/0245892 | A1 | | 10/2007 | Lemke et al. | |
| 2010/0071671 | A1 | | 3/2010 | Lemke | |
| 2010/0116240 | A1 | | 5/2010 | Campbell et al. | |
| 2012/0078491 | A1 | | 3/2012 | Erlandsson | |
| 2013/0025548 | A1 | † | 1/2013 | Liu | |
| 2016/0069293 | A1 | | 3/2016 | McClearen et al. | |
| 2016/0177862 | A1 | * | 6/2016 | Batta | F02F 1/004 123/41.01 |
| 2016/0252044 | A1 | | 9/2016 | Mc Clearen et al. | |
| 2016/0273470 | A1 | | 9/2016 | Lippitt | |
| 2016/0356239 | A1 | | 12/2016 | Graham et al. | |

FOREIGN PATENT DOCUMENTS

| | | | | | | |
|---|---|---|---|---|---|---|
| DE | 102012024177 | A1 | | | 6/2014 | |
| EP | 2980392 | A2 | | | 2/2016 | |
| FR | 437089 | A | | | 4/1912 | |
| FR | 2803874 | A1 | | | 7/2001 | |
| FR | 2957631 | A1 | | | 9/2011 | |
| GB | 247218 | A | | | 6/1926 | |
| GB | 851353 | | | † | 10/1960 | |
| GB | 2172651 | A | | * | 9/1986 | F02F 7/0007 |
| JP | 62038459 | U1 | | † | 3/1987 | |
| JP | 63243572 | A | | * | 10/1988 | F02G 1/053 |
| JP | 03021546 | U1 | | † | 3/1991 | |

OTHER PUBLICATIONS

The Junkers Jumo 205 Diesel Engine. Chapter 4. 7 pages.
Ralph Hosier's TechnoBlog. Opposed Pistons. [online]. Jun. 10, 2011.<URL:https://ralphhosier.wordpress.com/2011/06/10/opposed-pistons/>.
Regner, Gerhard. Modernizing the Opposed-Piston, Two-Stroke Diesel Engine for More Efficient Commercial Vehicle Applications. 2012 Achates Power, Inc. pp. 1-26.
Extended European Search Report for Application No. 16157508.9 dated Jul. 1, 2016.
Extended European Search Report for Application No. 16157520.4 dated Jul. 25, 2016.
U.S. Appl. No. 15/050,638, filed Feb. 23, 2016, James Mc Clearen et al.

* cited by examiner
† cited by third party

OPPOSED PISTON TWO STROKE ENGINE LINER CONSTRUCTION

CROSS-REFERENCE TO RELATED APPLICATIONS

This application claims the benefit of U.S. Provisional Application Ser. No. 62/126,088, filed on Feb. 27, 2015, and U.S. Provisional Application Ser. No. 62/121,777, filed on Feb. 27, 2015. This application is related to U.S. application Ser. No. 15/050,638, entitled "ENGINE BLOCK CONSTRUCTION FOR OPPOSED PISTON ENGINE", filed on Feb. 23, 2016. The entire disclosures of the applications referenced above are incorporated herein by reference.

FIELD

The present disclosure relates to internal combustion engines, and, more specifically, to a cylinder liner for insertion into a cylinder bore of an engine block.

BACKGROUND

This section provides background information related to the present disclosure which is not necessarily prior art.

Internal combustion engines may utilize cylinder liners or sleeves. Such internal combustion engines generally include an engine block having one or more cylinder bores. A piston is disposed within each cylinder bore when the internal combustion engine is fully assembled. Cylinder liners, which are generally cylindrical in shape, are positioned within the cylinder bore of the internal combustion engine between the piston and the engine block. Accordingly, the piston does not directly contact the engine block. Although cylinder liners often add complexity to the engine block, cylinder liners have some advantages. The cylinder liner presents a wear surface that can be replaced in the event of excessive wear. Excessive wear may occur in internal combustion engines that experience piston or ring failure. In such instances, the internal combustion engine can be more easily repaired without the need for re-boring and honing the engine block or replacing the engine block altogether. Cylinder liners can also be made from a different material than the material used in the engine block. Accordingly, the engine block can be made of a lighter, more brittle material such as aluminum to save weight, while the cylinder liner can be made of a heavier, stronger material such as cast iron to improve thermodynamics and durability.

One design problem that arises in internal combustion engines that utilize cylinder liners is how to effectively draw heat away from the cylinder liners. Cylinder liners are exposed to combustion and therefore are subject to high thermal loads. The cylinder liners themselves are relatively thin and often conduct heat better than the adjacent material of the engine block, making thermal management of the cylinder liner difficult. One solution to this problem is commonly referred to as a "wet liner" arrangement. In this arrangement, at least part of the cylinder liner is placed in direct contact with coolant water. The coolant water flows through a water jacket passageway disposed between at least a portion of the cylinder liner and the engine block. Thermal management is achieved more readily because heat from the cylinder liner is transferred directly to the coolant water. The coolant water in the water jacket passageway is replenished so that heat is continuously being drawn from the cylinder liner.

To increase heat transfer between the cylinder liner and the coolant water, several known designs call for cylinder liners with cut or cast-in grooves. While these designs do increase the surface area of the cylinder liner for improved cooling, the cut or cast-in grooves decrease the overall strength of the cylinder liner for any given liner wall thickness. Where the cylinder liner features cut grooves, the cutting operation removes material from the liner wall thereby weakening the cylinder liner. Where the cylinder liner features cast-in grooves, there is an absence of material adjacent the grooves (i.e. thinned areas in the liner wall). Accordingly, the cylinder liner is weak adjacent the grooves. Such cylinder liners sacrifice strength for cooling gains. As a result, these cylinder liners are more prone to deformation and failure during installation and operation of the internal combustion engine. Also, the compression ratio and maximum allowed engine speed (i.e. red-line rpms) of the internal combustion engine may have to be limited by the reduced strength of the cylinder liner.

SUMMARY

This section provides a general summary of the disclosure, and is not a comprehensive disclosure of its full scope or all of its features.

An example of a cylinder liner according to the present disclosure includes a first portion having a first end and a second end and a second portion having a first end and a second end. The second portion is separate from the first portion and the second end of the first portion overlays the first end of the second portion. The first portion and the second portion are configured to receive a piston slideably disposed within the first portion and the second portion.

The cylinder liner may further include a plurality of ports in the first portion and the second portion configured to fluidly communicate with at least one of an intake manifold and an exhaust manifold.

The cylinder liner may further include a plurality of intake ports in the second portion and a plurality of exhaust ports in the first portion.

The cylinder liner may further include a first portion having an extension that overlays the first end of the second portion.

The cylinder liner may further include a passage cut in an outer wall of the second portion, wherein the extension overlays the passage and cooperates with the passage to create fluid cooling channels in the second portion.

The cylinder liner may further include an extension having a plurality of bores configured to communicate fluid into the passage and out of the passage, such that the fluid enters the passage, circulates through the passage, and exits the passage to continuously cool the first portion and second portion.

The cylinder liner may further include a plurality of portions of the passage that extend beyond the extension and are configured to provide an entrance and an exit for fluid circulating through the passage, such that the fluid enters the passage through a first of the plurality of portions of the passage extending beyond the extension, circulates through the passage, and exits the passage through a second of the plurality of the portions of the passage extending beyond the extension to continuously cool the first portion and second portion.

The cylinder liner may further include a threaded portion on the second end of the first portion that engages with a threaded portion on the first end of the second portion to secure the first portion to the second portion.

The cylinder liner may further include a ring disposed within a notch in the first portion and a notch in the second portion, wherein the first portion, second portion, and ring are configured to receive a piston slideably disposed within the first portion, the second portion, and the ring.

The cylinder liner may further include a ring that mechanically connects the first portion to the second portion.

The cylinder liner may further include a threaded portion on the ring that engages a threaded portion on the second end of the first portion and a threaded portion on the first end of the second portion to secure the first portion to the second portion.

The cylinder liner may further include a ring that is formed of ceramic.

The cylinder liner may further include a ring that is coated with ceramic.

The cylinder liner may further include a ring that is a thermal coating applied to an inner surface of the first portion and the second portion.

The cylinder liner may further include a liner inner surface treatment on an inner surface of the first portion and the second portion.

The cylinder liner may further include a first portion and second portion that are formed of stainless steel.

An example of an engine according to the present disclosure includes a cylinder. A liner is disposed within the cylinder and has a first portion mechanically engaged to a second portion that is separate from the first portion. An end of the first portion overlays an end of the second portion. A piston is slideably disposed within the liner. The piston compresses an air and fuel mixture that combusts in a combustion area within the liner.

The engine may further include extension on the end of the first portion of the liner overlaying the end of the second portion of the liner.

The engine may further include a channel cut into the end of the second portion of the liner, wherein the extension overlays the channel and cooperates with the channel to provide a fluid passageway around the second portion for cooling the liner.

The engine may further include a threaded portion in the extension that mates with a threaded portion on the end of the second portion of the liner to secure the first portion of the liner to the second portion of the liner.

The engine may further include a ring disposed between the first portion and the second portion, wherein the ring is configured to provide a thermal barrier between the combustion area within the liner and the first and second portions.

The engine may further include a threaded portion on the ring of the liner that mates with a threaded portion on the extension of the liner and a threaded portion on the second portion of the liner to secure the first portion of the liner to the second portion of the liner.

The engine may further include a ring of the liner that is formed of ceramic.

The engine may further include a ring of the liner that is a thermal barrier coating applied to an inner wall of the first portion of the liner and an inner wall of the second portion of the liner.

The engine may further include a cylinder that is formed to accommodate the liner such that the cylinder further includes a first inner diameter to accommodate the first portion and the second portion and a second inner diameter that is larger than the first inner diameter to accommodate the extension.

The engine may further include a cylinder having a single inner diameter throughout that is sized to accommodate the extension and forms a gap between an inner wall of the cylinder and the first portion and the inner wall of the cylinder and the second portion.

The engine may further include a sealant injected within the gap between the inner wall of the cylinder and the first portion and the inner wall of the cylinder and the second portion.

The engine may further include a first portion of the liner and a second portion of the liner that are formed of stainless steel.

Another example of an engine according to the present disclosure includes a cylinder. A liner is disposed within the cylinder and includes a first cylindrical member mechanically engaged to, and partially overlapping, a second cylindrical member. A piston is slideably disposed within the liner.

The engine may further include a first cylindrical member having an extension that overlays a portion of the second cylindrical member.

The engine may further include an outer diameter of the first cylindrical member that is the same as an outer diameter of the second cylindrical member, and an inner diameter of the extension that is greater than the outer diameter of the first cylindrical member and the outer diameter of the second cylindrical member, such that the extension fits over the portion of the second cylindrical member.

The engine may further include a third cylindrical member, wherein the third cylindrical member is positioned within a stepped portion in the first cylindrical member and a stepped portion in the second cylindrical member such that an inner diameter of the first cylindrical member, an inner diameter of the second cylindrical member, and an inner diameter of the third cylindrical member are the same and form a smooth inner surface of the liner.

The engine may further include an outer diameter of the extension that is greater than an outer diameter of the first cylindrical member and the second cylindrical member.

The engine may further include an inner wall of the cylinder that is formed such that the cylinder has a plurality of inner diameters, a first inner diameter to accommodate the outer diameter of the first cylindrical member and the outer diameter of the second cylindrical member and a second inner diameter larger than the first inner diameter to accommodate the outer diameter of the extension.

The engine may further include an inner wall of the cylinder that is formed such that the cylinder has a single inner diameter throughout that accommodates the outer diameter of the extension and forms a gap between an outer wall of the first cylindrical member and the inner wall of the cylinder and an outer wall of the second cylindrical member and the inner wall of the cylinder.

The engine may further include a sealant injected into the gap between the outer wall of the first cylindrical member and the inner wall of the cylinder and the outer wall of the second cylindrical member and the inner wall of the cylinder.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Referring to the Figures, wherein like numerals indicate corresponding parts throughout the several views, an internal combustion engine 10 having a cylinder liner 14 is disclosed.

Initially referring to FIGS. 1-5, it should be understood that the cylinder liner 14 disclosed herein exists as one of many component parts of the engine 10. In general, the cylinder liner 14 may be utilized for each cylinder of the engine 10. The engine 10 could be, without limitation, a spark ignition engine (e.g. a gasoline fueled engine) or a compression ignition engine (e.g. a diesel fueled engine). The engine 10 may also be a multiple block engine. For example only, the engine 10 may be an opposed-piston engine as illustrated in FIGS. 1-5.

Figure 1:
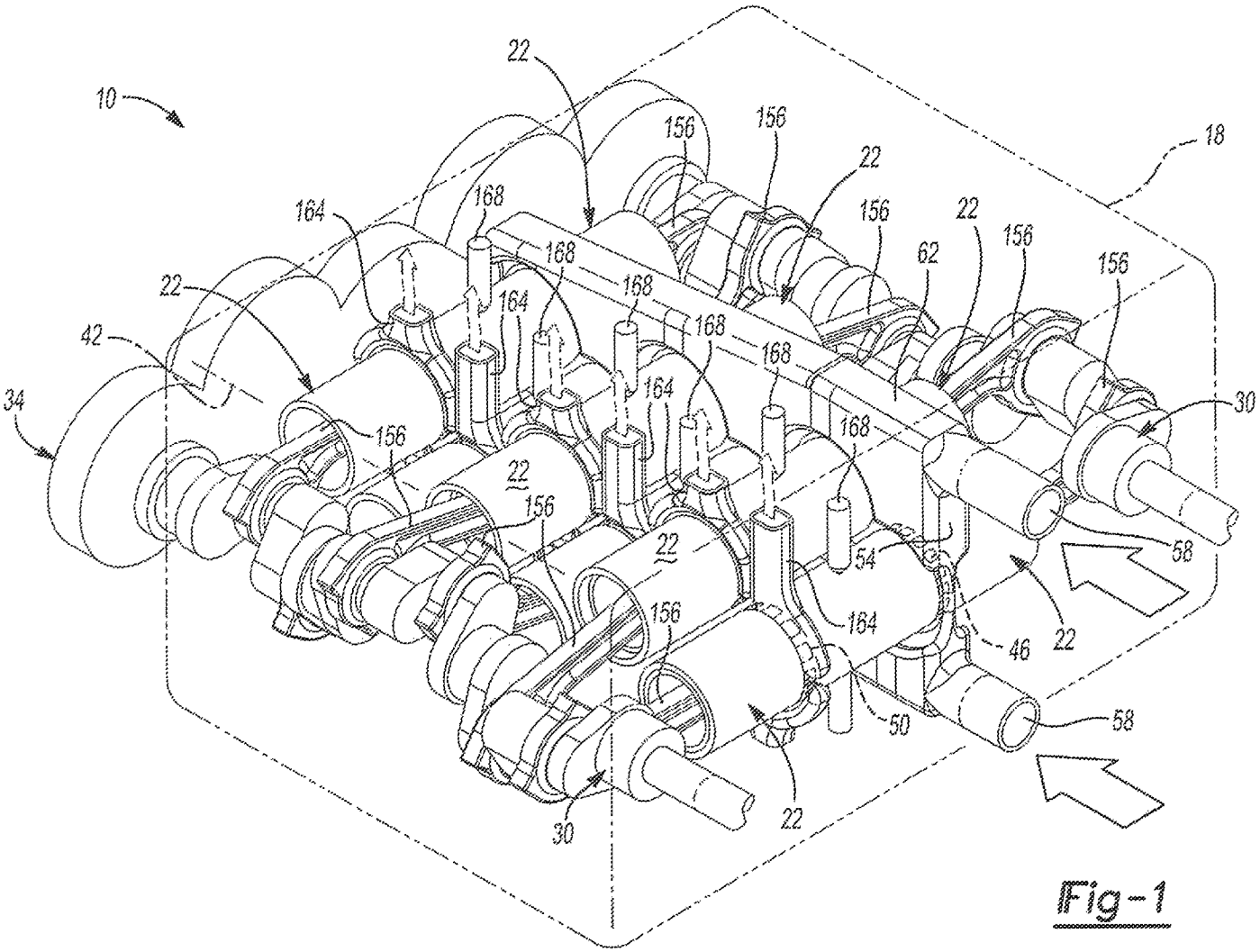
FIG. 1 is a perspective view of an engine including a cylinder liner in accordance with the principles of the present disclosure.
Figure 2:
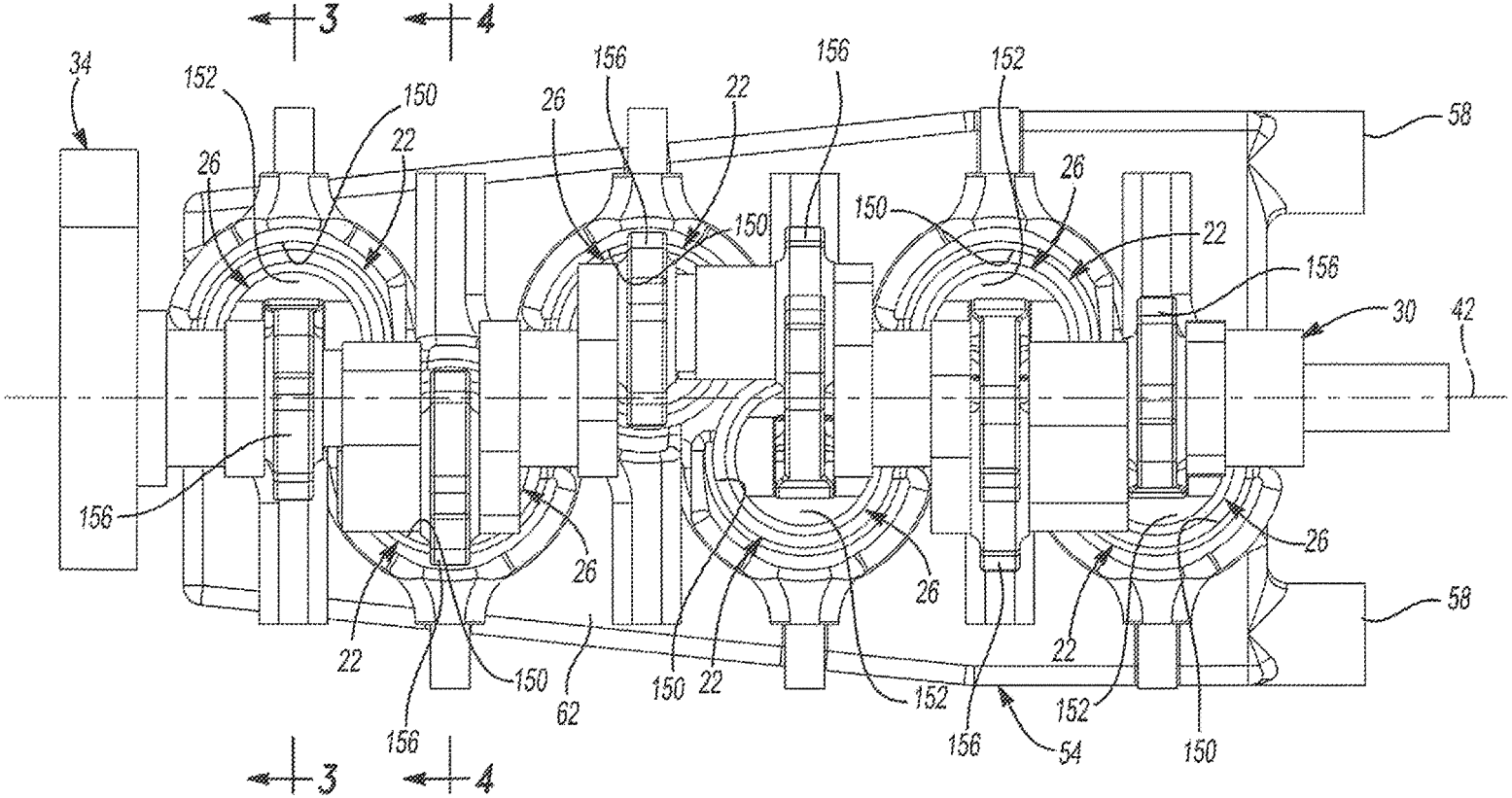
FIG. 2 is a side view of the engine of FIG. 1 showing an arrangement of cylinders of the engine.
Figure 3:
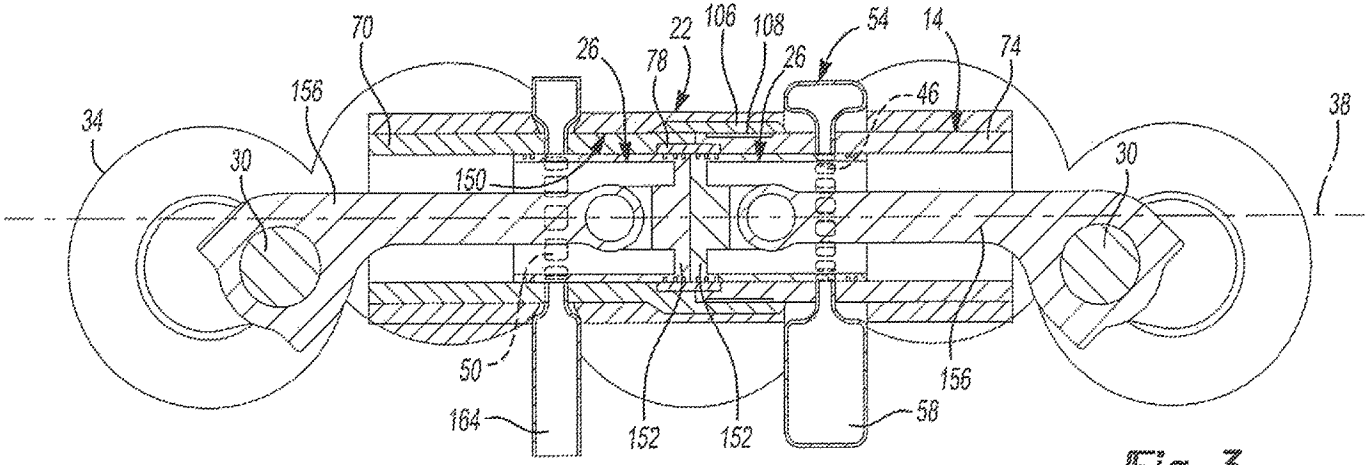
FIG. 3 is a cross-sectional view of the engine of FIG. 1 taken along line 3-3 of FIG. 2.
Figure 4:
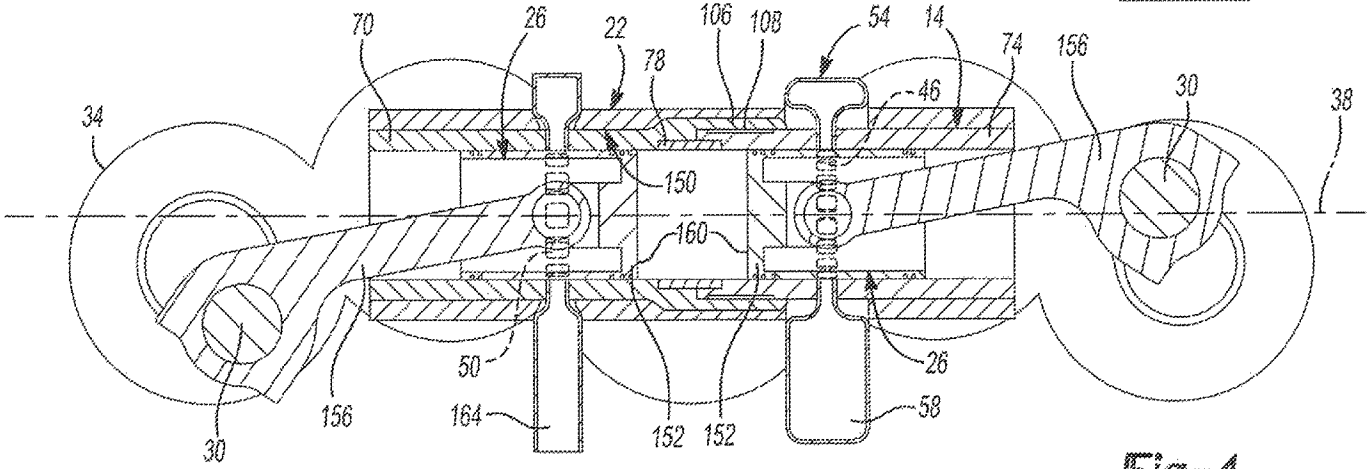
FIG. 4 is a cross-sectional view of the engine of FIG. 1 taken along line 4-4 of FIG. 2.
Figure 5:
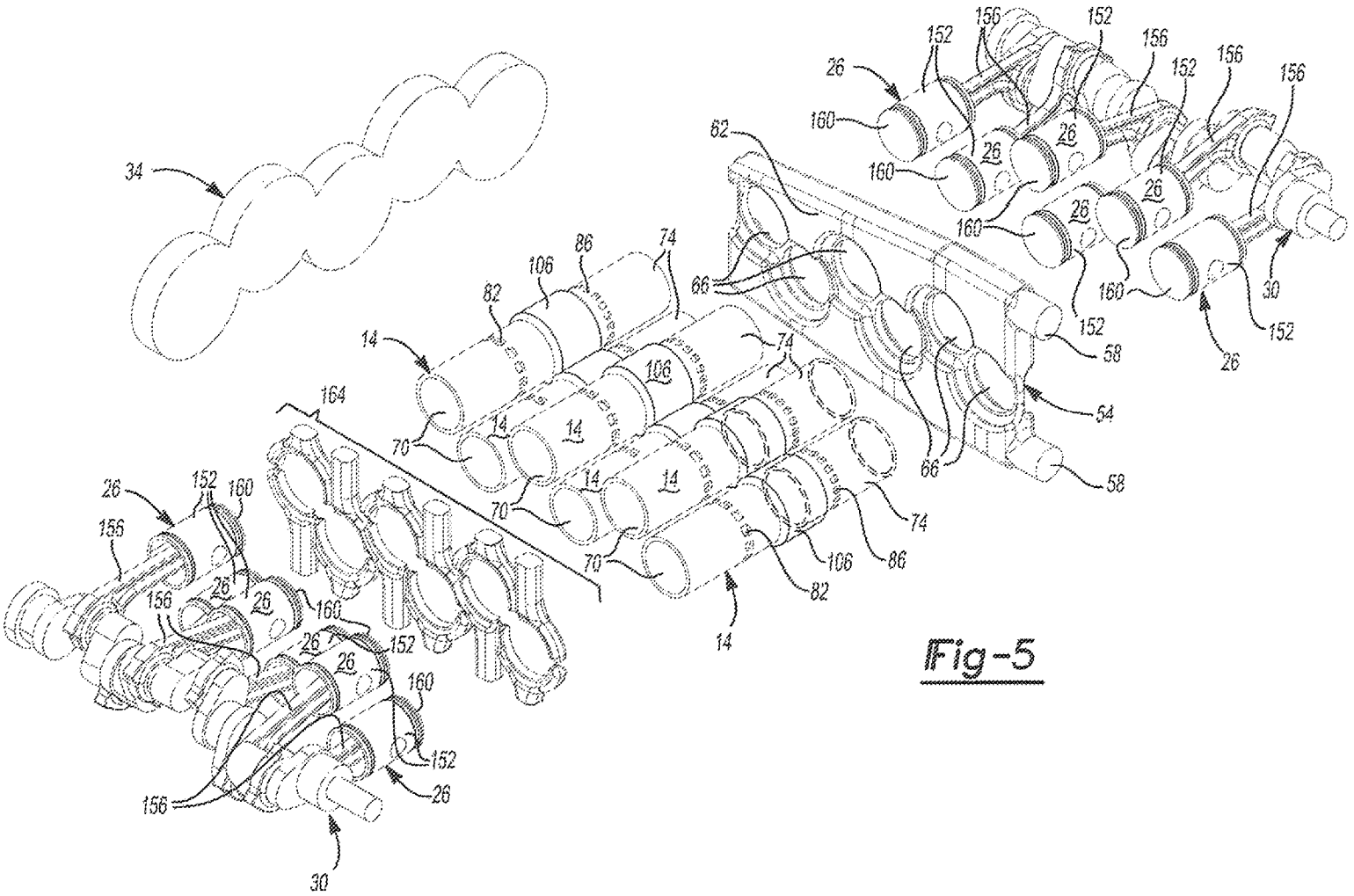
FIG. 5 is a partial exploded view of the engine of FIG. 1.

With reference to FIGS. 1 and 2, the internal combustion engine 10 generally includes an engine block 18 having a series of cylinders 22. The engine block 18 may have a multiple-block arrangement including multiple block segments (otherwise known as a crankcase having a split design), such as the engine block disclosed in U.S. Provisional Application No. 62/121,777, filed on Feb. 27, 2015, and U.S. application Ser. No. 15/050,638, entitled "ENGINE BLOCK CONSTRUCTION FOR OPPOSED PISTON ENGINE"), filed concurrently herewith, which are incorporated herein in their entirety. Each cylinder 22 includes a pair of pistons 26 slideably disposed therein and selectively movable toward one another (FIG. 3) and away from one another (FIG. 4). Movement of the pistons 26 relative to and within the cylinders 22 drives a pair of crankshafts 30 which, in turn, drive a gear train 34. The gear train 34 may be connected to driven wheels of a vehicle (neither shown), for example, whereby the crankshafts 30 and the gear train 34 cooperate to transform the linear motion of the pistons 26 to rotate the driven wheels and propel the vehicle.

The cylinders 22 are housed within the block 18 and each includes a longitudinal axis 38 (FIGS. 3-4) that extends substantially perpendicular to a rotational axis 42 of each crankshaft 30. As shown in FIG. 2, the cylinders 22 may be offset from one another in a so-called "nested" arrangement which allows the cylinders 22 to be packaged in a smaller engine block 18 than if the centers of the cylinders 22 were aligned.

The cylinders 22 each include a series of inlet ports 46 extending radially around and through an outer wall of the cylinders 22 and a series of outlet or exhaust ports 50 that similarly extend radially around and through the outer wall of each cylinder 22. The inlet ports 46 and the exhaust ports 50 are formed through the outer wall of the cylinders 22 to permit fluid communication through the wall of the cylinders 22 and into an interior of each cylinder 22.

The inlet ports 46 are in fluid communication with an intake manifold 54. The intake manifold 54 includes a pair of intake ports 58 that draw air into a body 62 of the intake manifold 54 which, in turn, communicates the air drawn into the intake ports 58 into each cylinder 22 via the inlet ports 46. In some embodiments, the air may be communicated to the cylinders 22 via an interface between a series of apertures 66 in the body 62 and the inlet ports 46 of each cylinder 22.

In some configurations, the intake ports 58 may receive a pressurized or charged stream of air from a supercharger (not shown). The supercharger directs pressurized air to the intake ports 58 of the intake manifold 54 to provide pressurized air to the cylinders 22 during operation of the engine 10.

Figure 6:
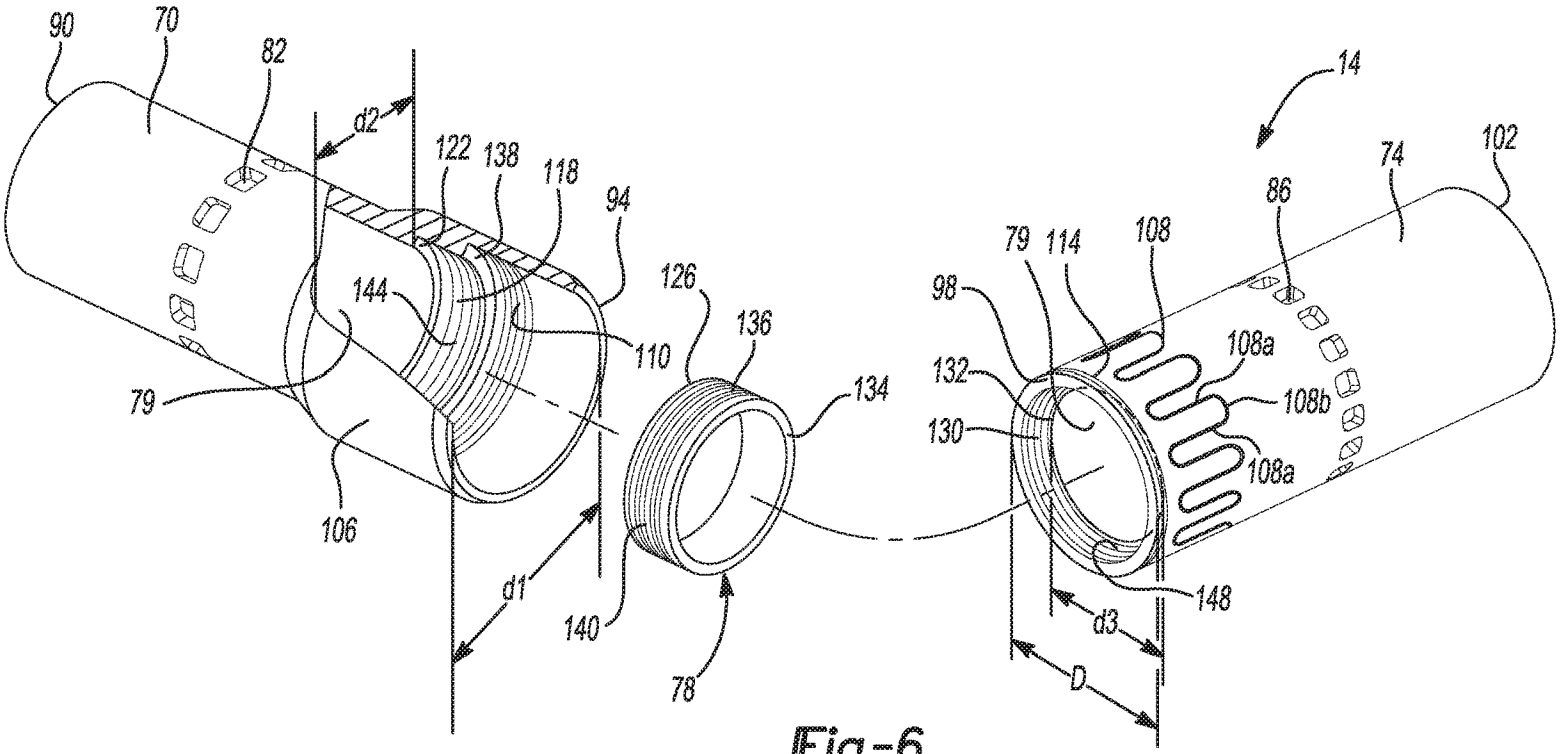
FIG. 6 is an exploded view of the engine liner of the engine of FIG. 1.

Referring additionally to FIG. 6, the cylinder liner 14 may be positioned within each cylinder 22. The liner 14 may include a first portion, or first cylindrical member, 70 mechanically connected to, or secured to, a second portion, or second cylindrical member, 74 and a cylindrical ring, or third cylindrical member, 78. The first portion 70 may include exhaust ports 82 aligning with exhaust ports 50 in the cylinder 22, and the second portion 74 may include inlet ports 86 aligning with inlet ports 46 in the cylinder 22. The exhaust ports 82 and inlet ports 86 may extend through a wall of each of the first portion 70 and the second portion 74, respectfully, and may form a pattern that extends around the circumference of the first portion 70 and the second portion 74, respectively. The exhaust ports 82 and the inlet ports 86 are formed through the wall of the first portion 70 and the second portion 74 to permit fluid communication through the wall of the first portion 70 and the second portion 74 and into an interior of each of the first portion 70 and the second portion 74.

The first portion 70 and second portion 74 may be cylindrical tubes formed from high strength liner material, such as, for example, alloy steel, stainless steel, high strength steel, and/or other high strength material. Additionally or alternatively, the first portion 70 and the second portion 74 may be formed from a thermally-insulating material such as ceramic. The first portion 70 may include a first end 90 and a second end 94, and the second portion 74 may include a first end 98 and a second end 102, where the second end 94 of the first portion 70 is secured to the first end 98 of the second portion 74. The first portion 70 may have an overlay portion or extension portion 106 on the second end 94 that extends over the first end 98 of the second portion 74. The extension 106 may be an increased diameter portion of the first portion 70 such that an inner diameter d1 of the extension 106 is larger than an inner diameter d2 of the first portion 70 adjacent to the first end 90. Further, the inner diameter d1 of the extension 106 is approximately equal to or slightly larger than an outer diameter D of the second portion 74 to provide a tight fit of the extension 106 over the second portion 74.

A passage or channel 108 may extend around a circumference of the second portion 74 adjacent to the first end 98. The passage 108 may be cut into the outer wall of the second portion 74 and may provide a passageway for fluid to flow and dissipate heat from the liner 14. The passage 108 may be serpentine-shaped, or sinusoidal-shaped, and may wind back and forth with straight portions 108*a* parallel to the longitudinal axis 38 and curved portions 108*b* connecting the straight portions. While the liner 14 is illustrated and described as having the serpentine-shaped passage 108, it is understood that any configuration of the passage 108 may be utilized to effectively draw heat away from the liner 14.

The extension 106 is secured to the first end 98 of the second portion 74. The extension 106 overlays the second portion 74 and extends to cover the passage 108 on the second portion 74. The extension 106 and passage 108 cooperate to create fluid passages, or fluid cooling channels, to dissipate heat from the liner 14 generated during combustion. Fluid such as water or coolant may flow through the passage 108 to cool the liner 14.

Figures 7, 8:
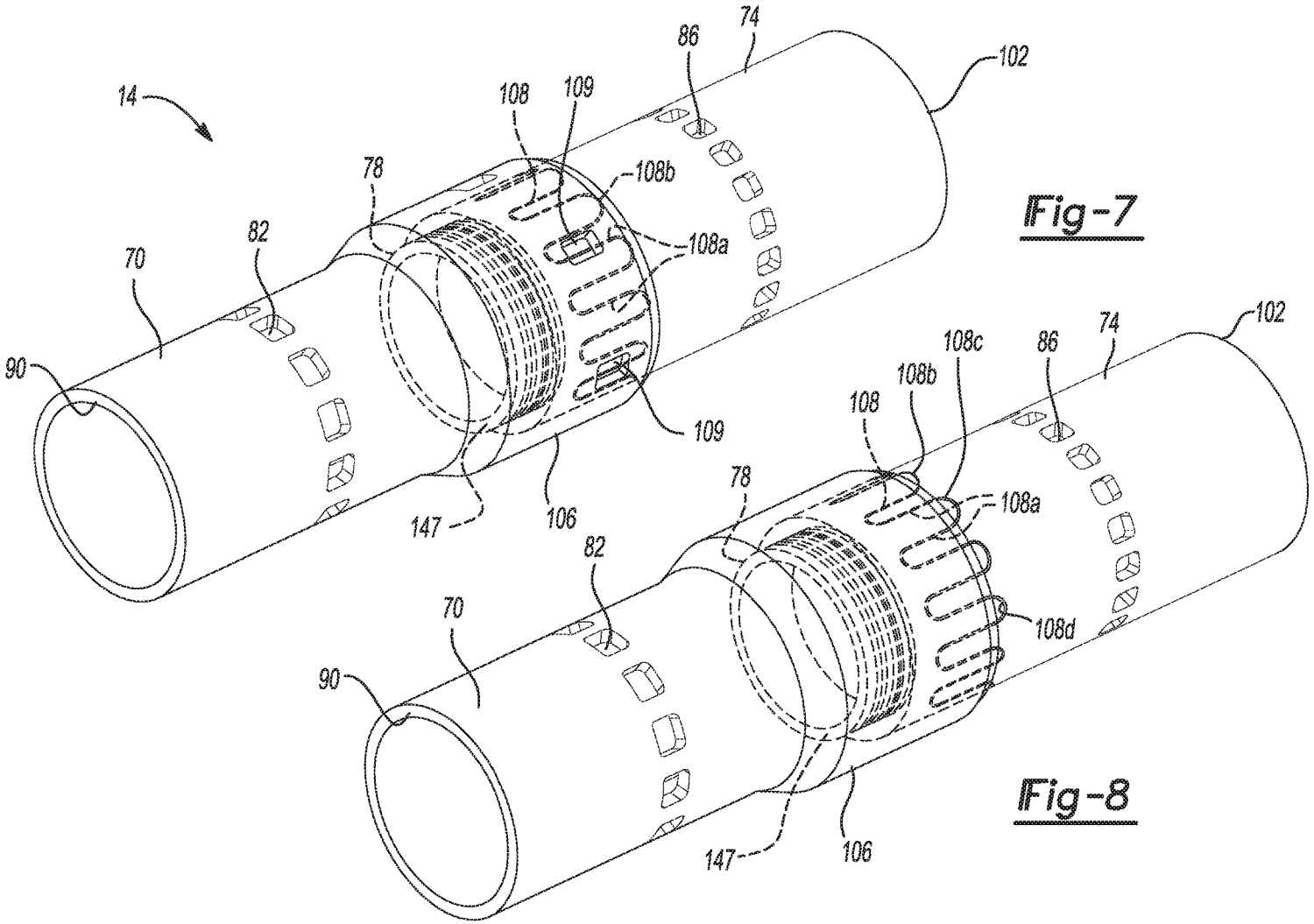
FIG. 7 is a perspective view of the engine liner of the engine of FIG. 1.
FIG. 8 is a perspective view of another engine liner of the engine of FIG. 1.

In some embodiments, such as the embodiment shown in FIG. 7, bores or holes 109 may be drilled into the extension 106 to communicate the fluid in and out of the passage 108. The fluid may be provided from the engine block 18 through holes in the cylinder 22 and the extension 106, circulated through the passage 108 around the second portion 74, removed through holes in the extension 106, taken away from the engine 10 to cool, and then recycled back through the passage 108 continuously to cool the liner 14.

In other embodiments, such as the embodiment of FIG. 8, a portion of the passage 108 may extend beyond the extension 106 to provide an entrance and exit to the fluid. For example, the fluid may be provided from the engine block 18 through holes in the cylinder 22, enter the passage 108 through an entrance 108*c* of the passage 108 extending beyond the extension 106, circulate through the passage 108 that is covered by the extension 106, exit through an exit 108*d* of the passage 108 extending beyond the extension 106, move away from the engine 10 to cool, and then recycle back through the passage 108 continuously to cool the liner 14.

The extension 106 may include a threaded section 110 that receives and engages a threaded section 114 on the first end 98 of the second portion 74 to secure the first portion 70 to the second portion 74. While threaded sections 110 and 114 are illustrated and described, it is understood that other methods of fixing extension 106 to first end 98 may be implemented, such as using adhesives or welding.

Cylindrical ring 78 may be positioned between first portion 70 and second portion 74. Cylindrical ring 78 may fit within a notch 118 in the extension 106. The notch 118 may be a stepped portion disposed between the section of the first portion 70 having the inner diameter d2 and the extension 106, and the inner diameter of the notch 118 may be less than the inner diameter d1 and greater than the inner diameter d2. As such, a lip or step 122 between the first portion 70 and the extension 106 may abut a first end 126 of the cylindrical ring 78.

The cylindrical ring 78 may also fit within a notch 130 in the first end 98 of the second portion 74. The notch 130 may be a larger diameter portion 130 between an inner diameter d3 and an outer diameter D of the second portion 74. As such, a lip or step 132 of the notch 130 may abut a second end 134 of the cylindrical ring 78. The extension 106 overlaps an outer wall 136 of the cylindrical ring. The cylindrical ring 78 may be secured between the first portion 70 and the second portion 74 when the extension 106 is secured to the first end 98 of the second portion 74.

The extension 106 may extend over the second portion 74 such that a lip, or stepped portion, 138 between the notch 118 and the extension 106 abuts the first end 98 of the second portion 74, the lip 122 of the first portion 70 abuts the first end 126 of the cylindrical ring 78, and the lip 132 of the second portion 74 abuts the second end 134 of the cylindrical ring 78. When assembled, the inner diameters of the first portion 70, cylindrical ring 78, and second portion 74 may align to form a seamless cylinder and a smooth inner surface.

The cylindrical ring 78 may also secure the first portion 70 and the second portion 74 together. In some embodiments, the cylindrical ring 78 may include a threaded section 140 on the outer wall 136. Threaded section 140 may mate with threaded sections 144 and 148 on notches 118 and 130, respectively. Threaded sections 140, 144, and 148 may cooperate to independently secure the first portion 70 and the second portion 74 to the cylindrical ring 78 and, thus, secure the first portion 70 to the second portion 74. In some embodiments threaded sections 110 and 114 may engage while engaging threaded sections 140, 144, and 148. In alternative embodiments only threaded sections 110 and 114 or threaded sections 140, 144, and 148 are engaged to secure the first portion 70 to the second portion 74.

The cylindrical ring 78 may be formed of a material such that the cylindrical ring 78 acts as a thermal barrier between (i) the combustion area (described in detail later) and (ii) the first portion 70 and the second portion 74 of the liner 14. For example only, the cylindrical ring 78 may be formed of a ceramic, or may have a ceramic coating. Because of the use of the ceramic for the cylindrical ring 78, the limitation on the thermal loads on the liner 14 can be increased compared to typical one-piece, iron designs. The ceramic material of the ring 78 can withstand higher temperatures and, thus, protect the first portion 70 and second portion 74 in the combustion area of the cylinder 22. Further, the ceramic material of the ring 78 can allow for the first portion 70 and the second portion 74 to be formed of stainless or high strength steel, which are higher strength (but also higher thermal conductivity) materials than the typical iron liner.

In another embodiment, the cylindrical ring 78 may be a thermal barrier coating 147 applied to the notch 118 in extension 106 and the notch 130 in the second portion 134. The thermal barrier coating 147 may be applied at a thickness that, when dried or set, appears approximately the same as the cylindrical ring 78 as previously described, except the thermal barrier coating 147 would not include threaded section 140, as described for other embodiments. The thermal barrier coating 147 may be applied after the first portion 70 is assembled onto the second portion 74 by injecting the thermal barrier coating 147 into the notches 118 and 130 and removing any excess material, or the thermal barrier coating 147 may be applied just before assembly by injecting the thermal barrier coating 147 into notches 118 and 130 and then removing excess material once the first portion 70 and second portion 74 are assembled. The thermal barrier coating 147 may be a ceramic coating to act as a thermal barrier between the combustion area and the first portion 70 and second portion 74.

Once the first portion 70, second portion 74 and cylindrical ring 78 are assembled, an inner surface treatment 79 (e.g., ceramic coatings, diamond-like carbon (DLC) coatings, or other heat protectant coatings) may be applied to the inner surface of the first portion 70, second portion 74, and cylindrical ring 78 assembly. The inner surface treatment 79 may provide additional durability against contact from the pistons 26 and/or heat from combustion.

Figure 9:
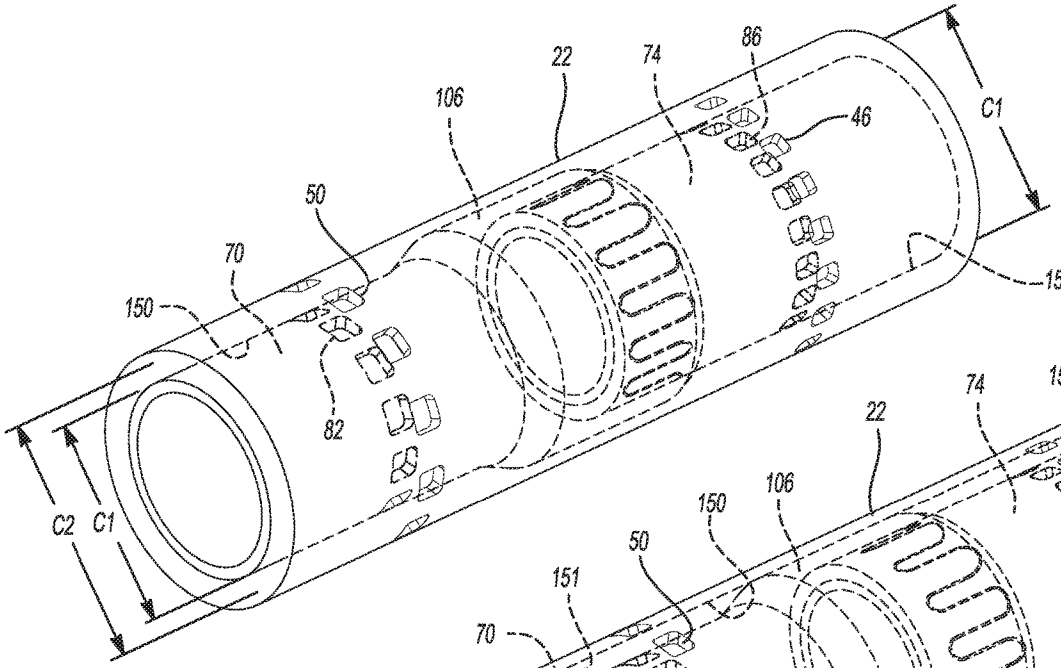
FIG. 9 is a perspective view of the cylinder having the engine liner of the engine of FIG. 1.
Figure 10:
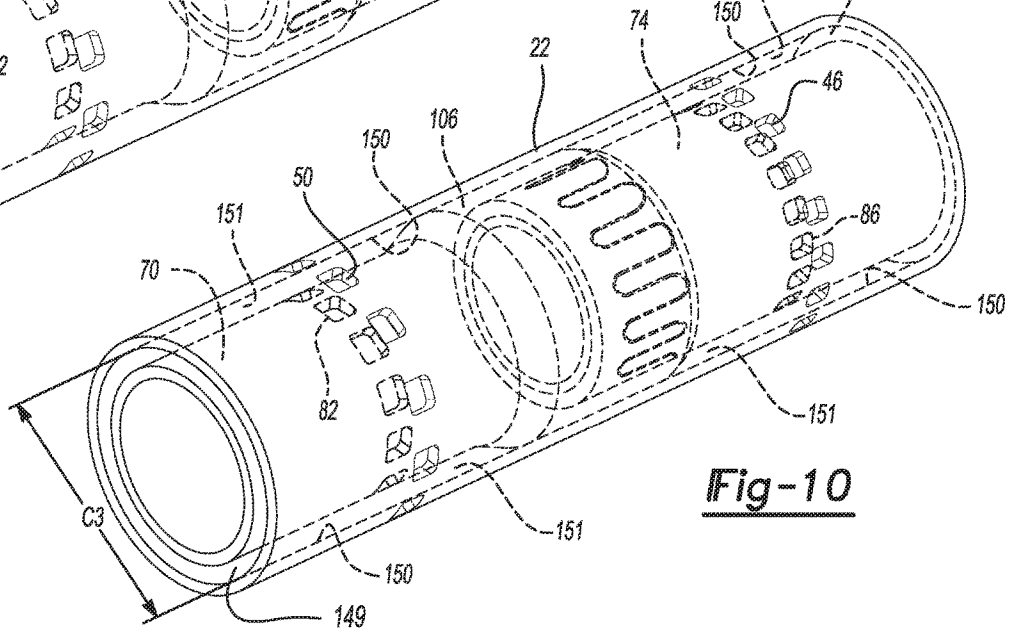
FIG. 10 is a perspective view of another cylinder having the engine liner of the engine of FIG. 1.

Referring to FIG. 9, an inner wall 150 of the cylinder 22 may be molded to accommodate the liner 14. For example, the cylinder 22 may have a plurality of inner diameters, a first inner diameter C1 to fit the first portion 70 and second portion 74 and a larger, second inner diameter C2, to fit the extension 106. In other embodiments, as shown in FIG. 10, the inner wall 138 of the cylinder 22 may be a single inner diameter C3 large enough to fit the extension 106, and a gap 151 between the inner wall 138 of the cylinder 22 and the outer wall of the first portion 70 and the second portion 74 may be filled with a sealant 149.

Sealant 149 may be injected between the portions 70, 74, 78 of the liner 14 and the cylinder 22 to seal the liner against water and exhaust gas. Because of the use of injected sealant 149 to seal the liner against water and exhaust gas, there is no need for o-rings, reducing costs and manufacture time and simplifying assembly of the engine.

Referring to FIGS. 1-5, the pistons 26 are slideably disposed within the liners 14 in the cylinders 22 and each includes a piston head 152 and a connecting rod 156. Once assembled, the piston heads 152 are slideably received within the liners 14 in the cylinders 22 and are connected to the crankshaft 30 via the connecting rods 156. The piston heads 152 are slideably disposed within the liners 14 such that a distal end 160 of each piston head 152 opposes the distal end 50 of another piston head 152 within the liner 14 in the cylinder 22.

The crankshafts 30 are positioned on opposite sides of the engine 10. Each crankshaft 30 is rotatably attached to and is driven by the piston heads 152 during operation of the engine 10. The connecting rods 156 may be attached to the crankshafts 30 along a length of the crankshafts. The connecting rods 156 may be attached to the crankshafts 30 at positions aligned with the rotational axis 42, or, alternatively, the positions may be offset from the rotational axis 42. By offsetting the locations where the connecting rods 156 are attached to the crankshafts 30, the piston heads 152 may be in different locations within each cylinder 22 at any given time.

During operation of the engine 10, the piston heads 152 may move toward one another (FIG. 3) and away from one another (FIG. 4) within the liner 14 of each cylinder 22. When the piston heads 152 are sufficiently moved away from one another, distal ends 160 of the piston heads 152 expose the inlet ports 86 and exhaust ports 82 of the liner 14 and the inlet ports 46 and exhaust ports 50 of the cylinder 22.

When the inlet ports 46, 86 are exposed, pressurized air is received by the liners 14 of the cylinders 22 via the inlet ports 46, 86 due to the air supplied to the intake manifold 54. The air flows into the liner 14 at the inlet ports 86 and, in doing so, forces exhaust gas disposed within the liner 14 in the cylinder 22 out of the liner 14 via the exhaust ports 82. The exhaust gas exits the exhaust ports 50, 82 and enters an exhaust manifold 164. As with the intake manifold 54, the exhaust manifold 164 surrounds each cylinder 22 and is in fluid communication with the liners 14 in the cylinders 22 via the exhaust ports 50, 82. Therefore, when the air enters the liners 14 at the inlet ports 86, the air causes the exhaust gas disposed within the liners 14 to exit the liners 14 and cylinders 22 and enter the exhaust manifold 164 via the exhaust ports 50, 82.

While the exhaust manifold 164 is illustrated as being a series of discrete manifolds, the exhaust manifold 164 could alternatively include a similar construction as the intake manifold 54. Further, while the engine 10 is illustrated as including a single intake manifold 54, the engine 10 could alternatively include a series of discrete intake manifolds 54, similar to the construction of the exhaust manifold 164.

Once air enters the liners 14 of the cylinders 22, the piston heads 152 move in a direction closer to each other. When the piston heads 152 are in a position whereby the distal ends 160 are in close proximity to one another, air disposed within the liner 14 is compressed due to movement of the piston heads 152 towards one another.

While the piston heads 152 are illustrated such that the intake stroke and the exhaust stroke are substantially identical, it is understood that the piston heads 152 could, alternatively have a non-uniform stroke such that the inlet stroke is longer than the exhaust stroke.

One or more fuel injectors 168 may be located along a length of each cylinder 22 at an area between each piston head 152 when the piston heads 152 are moved toward one another. Fuel may be injected into the liners 14 of the cylinders 22 by the fuel injectors 168 at a location proximate to the distal end 160 of each piston head 152 such that when the air disposed within the liner 14 is compressed between the distal ends 160 of each piston head 152, fuel is mixed with the compressed air, thereby causing combustion.

When the fuel/air mixture combusts, a force is generated, thereby causing the piston heads 152 to move away from one another along the longitudinal axis 38 of the liner 14. In doing so, an axial force is applied to the respective connecting rods 156 of the piston heads 152 which, in turn, causes the particular crankshaft 30 to rotate. Rotation of the crankshaft 30 likewise causes movement of the other piston heads 152 attached to the crankshaft 30. Further, rotation of the crankshaft 30 causes a rotational force to be applied to the gear train 34 which, in turn, causes a rotational force to be applied to driven wheels of a vehicle, for example.

While combustion is described as the mixture of fuel and air, it is understood that combustion could also include the application of spark to the fuel/air mixture causing ignition of the mixture and generating a force causing the piston heads 152 to move away from one another along the longitudinal axis 38 of the liner 14. The spark may be generated by a spark plug (not illustrated) located near the fuel injector 168 between each piston head 152 when the piston heads 152 are moved toward one another.

During combustion, the mixture (and/or ignition) of the fuel and air causes significant heat to be generated in the area between the piston heads 152. Much of the heat is absorbed by the liner 14 surrounding the combustion area. The cylindrical ring 78 surrounds the combustion area and acts as a thermal barrier between the combustion area and the first portion 70 and the second portion 74 of the liner 14. Because the cylindrical ring 78 may be formed of ceramic, the limitation of the thermal loads on the liner 14 can be increased compared to typical one-piece iron designs. The ceramic material of the ring 78 can withstand higher temperatures and thus protect the first portion 70 and second portion 74 in the combustion area of the cylinder 22. Further, the ceramic material of the ring 78 can allow for the first portion 70 and the second portion 74 to be formed of stainless steel, a higher strength material than the typical iron liner because of the thermal protection.

When the distal ends 160 of each piston head 152 move apart from one another and the piston heads 152 sufficiently move along the longitudinal axis 38 in a direction away from one another, the inlet ports 86 and exhaust ports 82 of the liner 14 and the inlet ports 46 and exhaust ports 50 of the cylinder 22 are once again exposed and the cycle begins anew.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cylinder liner for an engine comprising:

a first portion having a first end and a second end;

a second portion having a first end and a second end, wherein the second portion is separate from the first portion and the second end of the first portion overlays the first end of the second portion, wherein the first portion and the second portion are configured to receive a piston slideably disposed within the first portion and the second portion, wherein the second end of the first portion includes an extension that overlays the first end of the second portion, the extension having an inner diameter that is larger than an inner diameter of the first portion adjacent to the first end; and a ring disposed entirely within the extension of the first portion such that the ring abuts the first end of the second portion.

2. The cylinder liner of claim 1, further comprising a plurality of ports in the first portion and the second portion configured to fluidly communicate with at least one of an intake manifold and an exhaust manifold.

3. The cylinder liner of claim 2, further comprising a plurality of intake ports in the second portion and a plurality of exhaust ports in the first portion.

4. The cylinder liner of claim 1, wherein the inner diameters of the first portion, the ring, and the second portion are equal to one another and form a smooth inner surface.

5. A cylinder liner for an engine comprising:

a first portion having a first end and a second end;

a second portion having a first end and a second end, wherein the second portion is separate from the first portion and the second end of the first portion overlays the first end of the second portion, wherein the first portion and the second portion are configured to receive a piston slideably disposed within the first portion and the second portion; and a passage formed in an outer wall of the second portion, wherein the extension overlays the passage and cooperates with the passage to create fluid cooling channels in the second portion.

6. The cylinder liner of claim 5, wherein the extension further includes a plurality of bores configured to communicate fluid into the passage and out of the passage, such that the fluid enters the passage, circulates through the passage, and exits the passage to continuously cool the first portion and second portion.

7. The cylinder liner of claim 5, wherein a plurality of portions of the passage extend beyond the extension and are configured to provide an entrance and an exit for fluid circulating through the passage, such that the fluid enters the passage through a first of the plurality of portions of the passage extending beyond the extension, circulates through the passage, and exits the passage through a second of the plurality of the portions of the passage extending beyond the extension to continuously cool the first portion and second portion.

8. The cylinder liner of claim 1, further comprising a threaded portion on the second end of the first portion that engages with a threaded portion on the first end of the second portion to secure the first portion to the second portion.

9. The cylinder liner of claim 1, wherein the ring is disposed within a notch in the second end of the first portion and a notch in the first end of the second portion, wherein the first portion, second portion, and ring are configured to receive the piston slideably disposed within the first portion, the second portion, and the ring.

10. The cylinder liner of claim 1, wherein the ring mechanically connects the first portion to the second portion.

11. The cylinder liner of claim 10, further comprising a threaded portion on the ring that engages a threaded portion on the second end of the first portion and a threaded portion on the first end of the second portion to secure the first portion to the second portion.

12. The cylinder liner of claim 1, wherein the ring is formed of ceramic.

13. The cylinder liner of claim 1, wherein the ring is coated with ceramic.

14. The cylinder liner of claim 1, wherein the ring is made of a thermal barrier coating that is applied to notches in the first portion and the second portion.

15. The cylinder liner of claim 1, wherein an inner surface treatment is applied to an inner surface of the first portion and the second portion for additional durability.

16. The cylinder liner of claim 1, wherein the first portion and second portion are formed of stainless steel.

17. An engine comprising:

a cylinder;

a liner disposed within the cylinder and having a first portion mechanically engaged to a second portion that is separate from the first portion, wherein an end of the first portion overlays an end of the second portion;

a piston slideably disposed within the liner, wherein the piston compresses an air and fuel mixture that combusts in a combustion area within the liner, wherein the end of the first portion that overlays the end of the second portion has an inner diameter that is larger than an outer diameter of the second portion; and a ring disposed entirely within the end of the first portion that overlays the end of the second portion such that the ring abuts the end of the second portion.

18. The engine of claim 17, further comprising an extension on the end of the first portion of the liner overlaying the end of the second portion of the liner.

19. An engine comprising:

a cylinder:

a liner disposed within the cylinder and having a first portion mechanically engaged to a second portion that is separate from the first portion, wherein an end of the first portion overlays an end of the second portion;

a piston slideably disposed within the liner, wherein the piston compresses an air and fuel mixture that combusts in a combustion area within the liner;

an extension on the end of the first portion of the liner overlaying the end of the second portion of the liner; and a channel cut into the end of the second portion of the liner, wherein the extension overlays the channel and cooperates with the channel to provide a fluid passageway around the second portion for cooling the liner.

20. The engine of claim 18, further comprising a threaded portion in the extension that mates with a threaded portion on the end of the second portion of the liner to secure the first portion of the liner to the second portion of the liner.

21. The engine of claim 17, wherein the ring is configured to provide a thermal barrier between the combustion area within the liner and the first and second portions.

22. The engine of claim 17, further comprising a threaded portion on the ring that mates with a threaded portion on the extension of the liner and a threaded portion on the second portion of the liner to secure the first portion of the liner to the second portion of the liner.

23. The engine of claim 17, wherein the ring of the liner is formed of ceramic.

24. The engine of claim 17, wherein the ring is made of a thermal barrier coating that is applied to notches in the first portion of the liner and the second portion of the liner.

25. The engine of claim 18, wherein the cylinder is formed to accommodate the liner such that the cylinder further includes a first inner diameter to accommodate the first portion and the second portion and a second inner diameter that is larger than the first inner diameter to accommodate the extension.

26. The engine of claim 18, wherein the cylinder further includes a single inner diameter throughout that is sized to accommodate the extension and forms a gap between an inner wall of the cylinder and the first portion and the inner wall of the cylinder and the second portion.

27. The engine of claim 26, further comprising a sealant injected within the gap between the inner wall of the cylinder and the first portion and the inner wall of the cylinder and the second portion.

28. The engine of claim 17, wherein the first portion of the liner and the second portion of the liner are formed of stainless steel.

29. An engine comprising:

a cylinder;

a liner disposed within the cylinder and having a first cylindrical member mechanically engaged to, and partially overlapping, a second cylindrical member;

a piston slideably disposed within the liner, wherein the first cylindrical member includes an extension that overlays a portion of the second cylindrical member; and a ring disposed entirely within the extension of the first cylindrical member such that the ring abuts the second cylindrical member.

30. The engine of claim 29, wherein the first cylindrical member, the second cylindrical member, and the ring have inner diameters that form a smooth inner surface of the liner.

31. The engine of claim 30, wherein an outer diameter of the first cylindrical member is the same as an outer diameter of the second cylindrical member, and an inner diameter of the extension is greater than the outer diameter of the first cylindrical member and the outer diameter of the second cylindrical member, such that the extension fits over the portion of the second cylindrical member.

32. The engine of claim 30, wherein an outer diameter of the extension is greater than an outer diameter of the first cylindrical member and the second cylindrical member.

33. The engine of claim 32, wherein an inner wall of the cylinder is formed such that the cylinder has a plurality of inner diameters, a first inner diameter to accommodate the outer diameter of the first cylindrical member and the outer diameter of the second cylindrical member and a second inner diameter larger than the first inner diameter to accommodate the outer diameter of the extension.

34. The engine of claim 32, wherein an inner wall of the cylinder is formed such that the cylinder has a single inner diameter throughout that accommodates the outer diameter of the extension and forms a gap between an outer wall of the first cylindrical member and the inner wall of the cylinder and an outer wall of the second cylindrical member and the inner wall of the cylinder.

35. The engine of claim 34, further comprising a sealant injected into the gap between the outer wall of the first cylindrical member and the inner wall of the cylinder and the outer wall of the second cylindrical member and the inner wall of the cylinder.

36. The engine of claim 29, wherein the ring is positioned within a stepped portion in the first cylindrical member and a stepped portion in the second cylindrical member such that an inner diameter of the first cylindrical member, an inner diameter of the second cylindrical member, and an inner diameter of the third cylindrical member are the same and form a smooth inner surface of the liner.

* * * * *